US007347670B1

(12) United States Patent
Henderson

(10) Patent No.: US 7,347,670 B1
(45) Date of Patent: Mar. 25, 2008

(54) INTERCHANGEABLE FOLDING HAND FAN FOR PURSES OR POCKETS

(76) Inventor: Cynthia Chisholm Henderson, 732 Faraway Ct., Mitchellville, MD (US) 20721

( * ) Notice: Subject to any disclaimer, the term of this patent is extended or adjusted under 35 U.S.C. 154(b) by 239 days.

(21) Appl. No.: 11/240,536

(22) Filed: Oct. 3, 2005

(51) Int. Cl.
*A45B 27/02* (2006.01)

(52) U.S. Cl. ..... 416/70 A; 416/71

(58) Field of Classification Search ..... 416/63, 416/72, 71, 73, 70 A
See application file for complete search history.

(56) References Cited

U.S. PATENT DOCUMENTS 338,881 A * 3/1886 Scheuer ..... 416/73
519,554 A * 5/1894 Rubin ..... 416/73
555,339 A * 2/1896 Rubin ..... 416/54
760,452 A * 5/1904 Helm ..... 416/73
835,433 A * 11/1906 Hulsizer ..... 416/73
5,967,161 A * 10/1999 Neal ..... 135/19.5
7,128,531 B1 * 10/2006 Cobb ..... 416/73
2003/0108421 A1 * 6/2003 DuBois ..... 416/71

* cited by examiner

*Primary Examiner*—Edward K. Look
*Assistant Examiner*—Dwayne J White

(57) ABSTRACT

The present invention is a folding hand fan with decorative handles and removable interchangeable fan inserts that can be inserted into the different fan handles to create a totally different look of the fan to match a woman's clothes. The folding hand fan insert unit is inserted into the fan handles, and the entire hand held fan apparatus opens up to provide a 360 degree arc to move air currents towards the face. The uniqueness and benefits of this folding hand fan include: the fan folds down to fit in a woman's purse or pocket; the fan inserts can be changed to match different clothes by removing one insert from the handle and replacing it with another fan insert; the fan handle fits comfortably into a woman's hand and is ergonomically correct; and the fan inserts are made of: (1) fabric reinforced with sizing; or (2) paper reinforced with sizing. The materials for the fan handle may be made from a group of a suitable laminated wood, metal or plastic.

6 Claims, 4 Drawing Sheets

INTERCHANGEABLE FOLDING HAND FAN FOR PURSES OR POCKETS

BACKGROUND OF THE INVENTION

1. Field of the Invention

This invention relates to folding purse/pocket hand fans used to propel air currents towards the face.

2. Description of Prior Art

Folding purse/pocket hand fans are well known. The fans are formed with folded paper connected to the base and fan handles with an adhesive. When the handles are opened and the fan is spread, a flat sector is formed which is useful for holding in a hand and moving back and forth to propel air currents. The sector is formed with up to 360 degree arc. Usually the folding fans are decorative. Use of the fans has been limited to propelling air and decorations. Wide use of the highly collapsible and portable nature of the fans has not been made.

In this application a new and improved style of folding purse/pocket hand fans is presented.

REFERENCES CITED

The following reference for pocket fans is of record in the file of this patent:

| Number | Name | Date |
|---|---|---|
| U.S. Pat. No. 555,339 | Rubin | 1896 |

3. Objects

It is the general object of this invention to provide a highly efficient and effective hand fan, with interchangeable fan inserts, that propels air naturally towards the face.

It is another object of this invention to provide a very convenient hand fan that fits in a woman's purse or pocket.

It is a further object of this invention to provide decorative, unique, removable and interchangeable fan inserts for the fan handles.

It is another object of this invention to provide fan inserts with a 360 degree arc for the folding hand fan.

It is a related objective to provide decorative fan handles that fit easily and comfortable in a woman's hand.

SUMMARY OF THE INVENTION

The present invention is a folding hand fan with decorative handles and removable interchangeable fan inserts that can be inserted into the different fan handles. The folding hand fan insert unit is inserted into the fan handles, and the entire hand held fan apparatus opens up to provide a 360 degree arc to move air currents towards the face. The uniqueness and benefits of this folding hand fan include:

The fan folds down to fit in a woman's purse or pocket;

The fan inserts can be changed by removing one insert from the handle and replacing it with another fan insert;

The fan handle fits comfortably into a woman's hand and is ergonomically correct; and The fan inserts are made of: (1) fabric reinforced with sizing; or (2) paper reinforced with sizing.

The materials for the fan handle may be made from a group of a suitable laminated wood, metal or plastic.

BRIEF DESCRIPTION OF THE DRAWINGS

The present invention and its objects and aspects may become more readily apparent from the accompanying drawings that further describe the invention.

DETAILED DESCRIPTION OF THE PREFERRED EMBODIMENTS

The present invention is a folding hand fan with decorative handles and removable interchangeable fan inserts that are inserted into the fan handles. When the fan insert unit is inserted into the fan handles, the fan opens up to provide a 360 degree arc to move air currents towards the face. The uniqueness and benefits of this folding hand fan include: the fan folds down to fit in a woman's purse or pocket, and the fan inserts can be changed by removing one insert from the handle and replacing it with another fan insert; the fan handle fits comfortably into a woman's hand and is ergonomically correct; and the fan inserts are made of: (1) fabric reinforced with sizing; or (2) paper reinforced with sizing.

A key to identify the components of the interchangeable hand-held fan apparatus is:

A→Fan insert accordion folded made from a group of sizing-treated paper or fabric.

B→Fan handles

C→Connector plate for handles

D→Screws for the connector plate

E→Magnets in the handles

F→Female gliders in handle to receive fan insert

G→Male glider casing attached to side of fan insert

Figure 1:
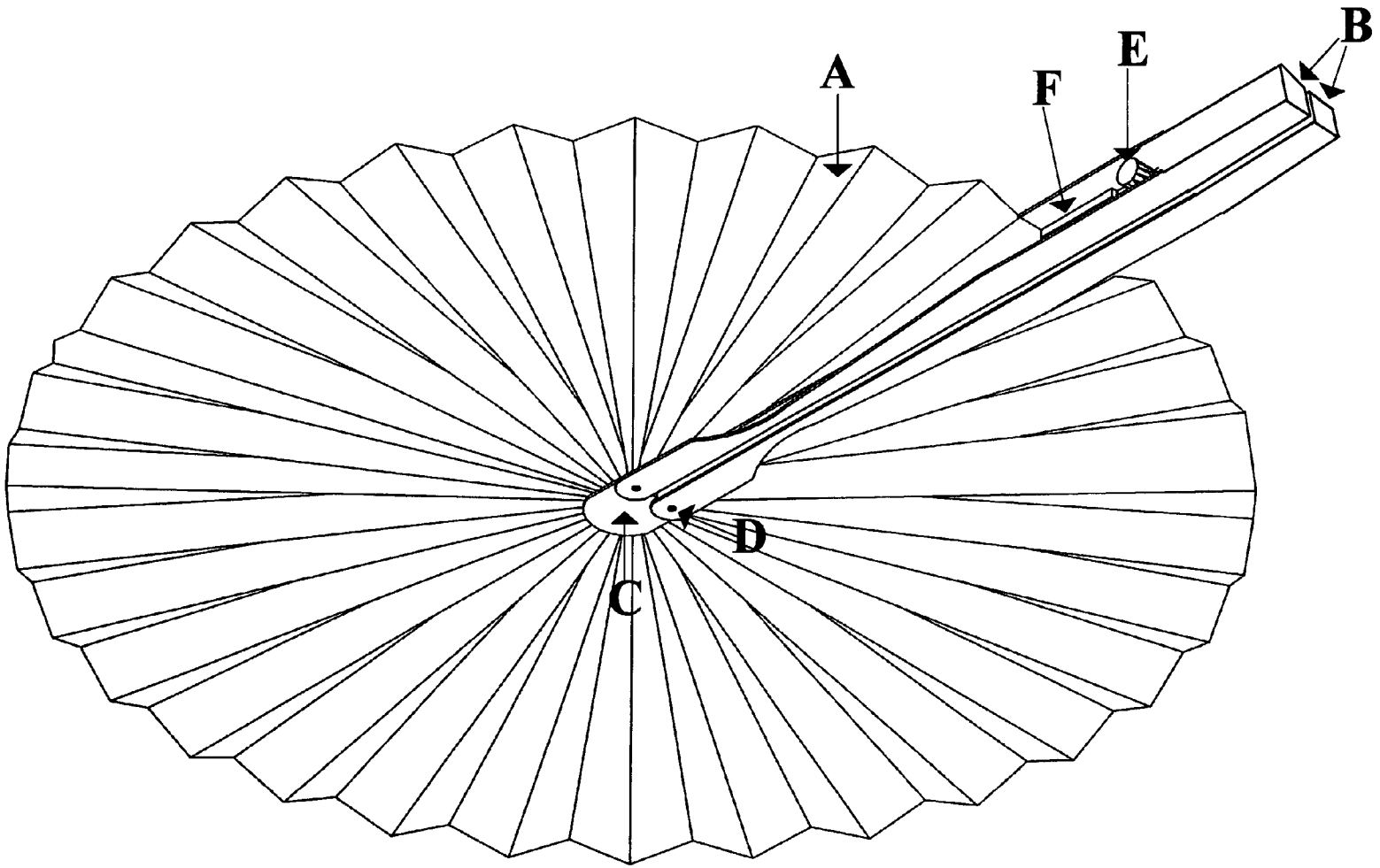
FIG. 1 Drawing of the entire opened interchangeable hand held-fan with paper or fabric materials (A), fan handles (B), fan handle glider (F), magnet (E), also illustrating the connector plates (C), screws and pins (D).

H→Spring-board internal locking device attached to female glider casing on fan insert I→Paper tape binding at base of fan insert J→Docking port on handle to receive spring-board internal docking The materials for the fan handle may be a suitable laminated wood, metal or plastic (FIG. 1-B), and the fan insert material may be a fabric or treated paper FIG. 1-A. The fan insert is made of a fabric or paper reinforced with sizing, is cut in an oblong shape, is folded (accordion style) FIG. 4-A, and is bonded with an adhesive at the base of the accordion fold, and secured with the adhesive attaching the fabric or paper to a paper tape binding at the base and side of the fan insert. (FIG. 4-I)

Figures 4, 5, 6:
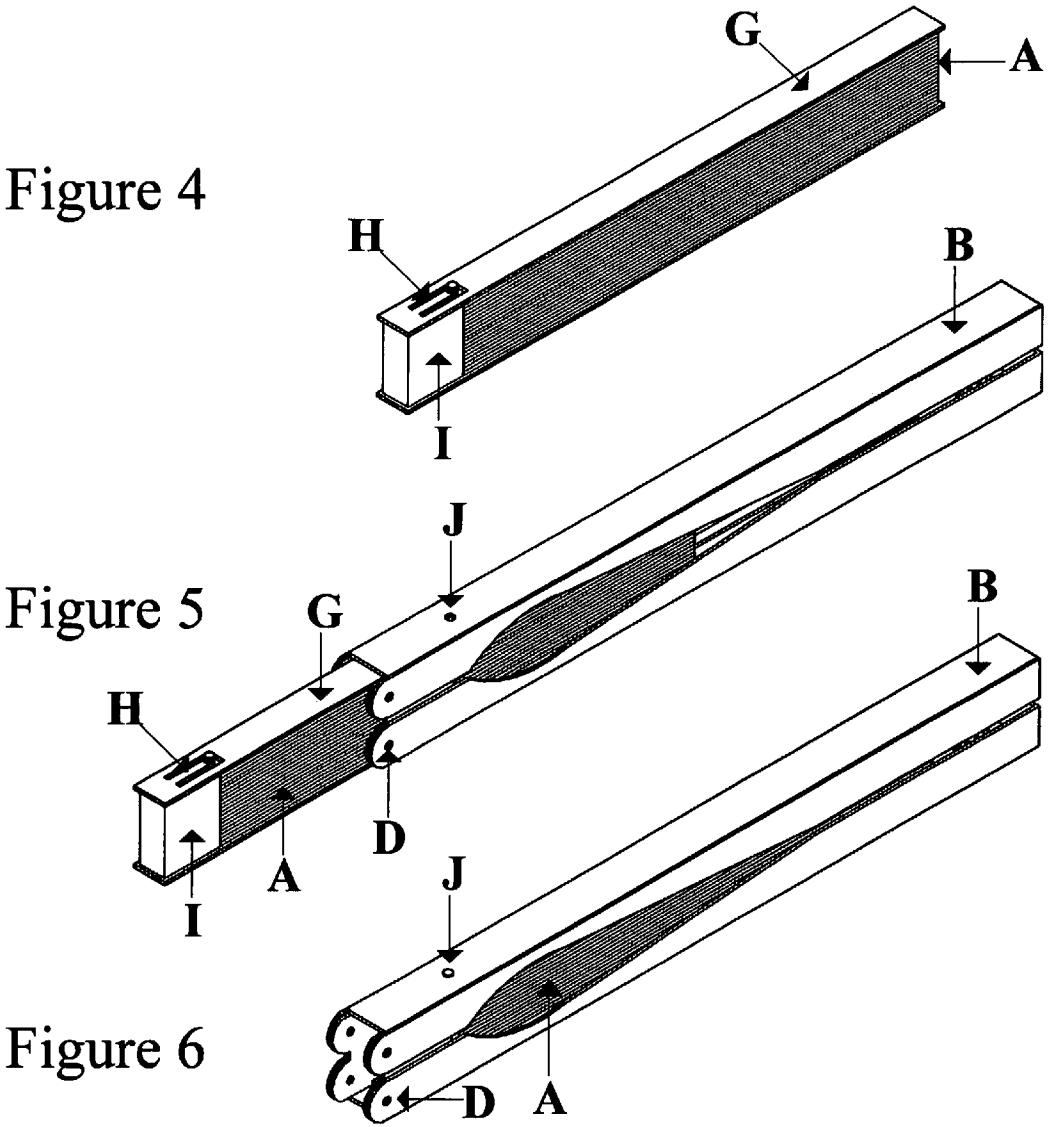
FIG. 4 Closed interchangeable fan insert unit bound with tape binding (I) and showing locking mechanism (H) at bottom of attached gliders (G).
FIG. 5 Closed interchangeable fan insert unit being inserted into fan handle unit.
FIG. 6 Closed interchangeable fan insert unit secured in place into fan handle unit showing docking port (J).
Figure 7:
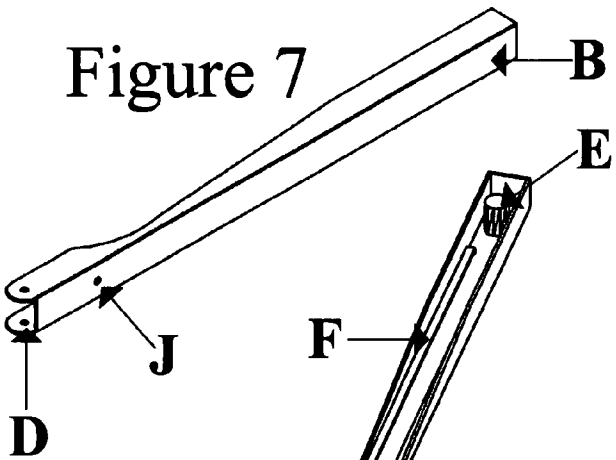
FIG. 7 View of external fan handle (B) with locking port visible (J) and connector plate screw hole (D).

A plastic male glider casing with grooved sides is attached to the sides of the fan insert with an adhesive (FIG. 4-G). A locking mechanism is slightly elevated above one side of the plastic casing (FIG. 4-H) so that the fan inserts can be removed or inserted into various fan handles and stops when the inserts reaches to the correct position—the locking mechanism on the fan insert (FIG. 5-H) docks in place on the docking port (FIG. 5-J) of the fan handle.

Figure 2:
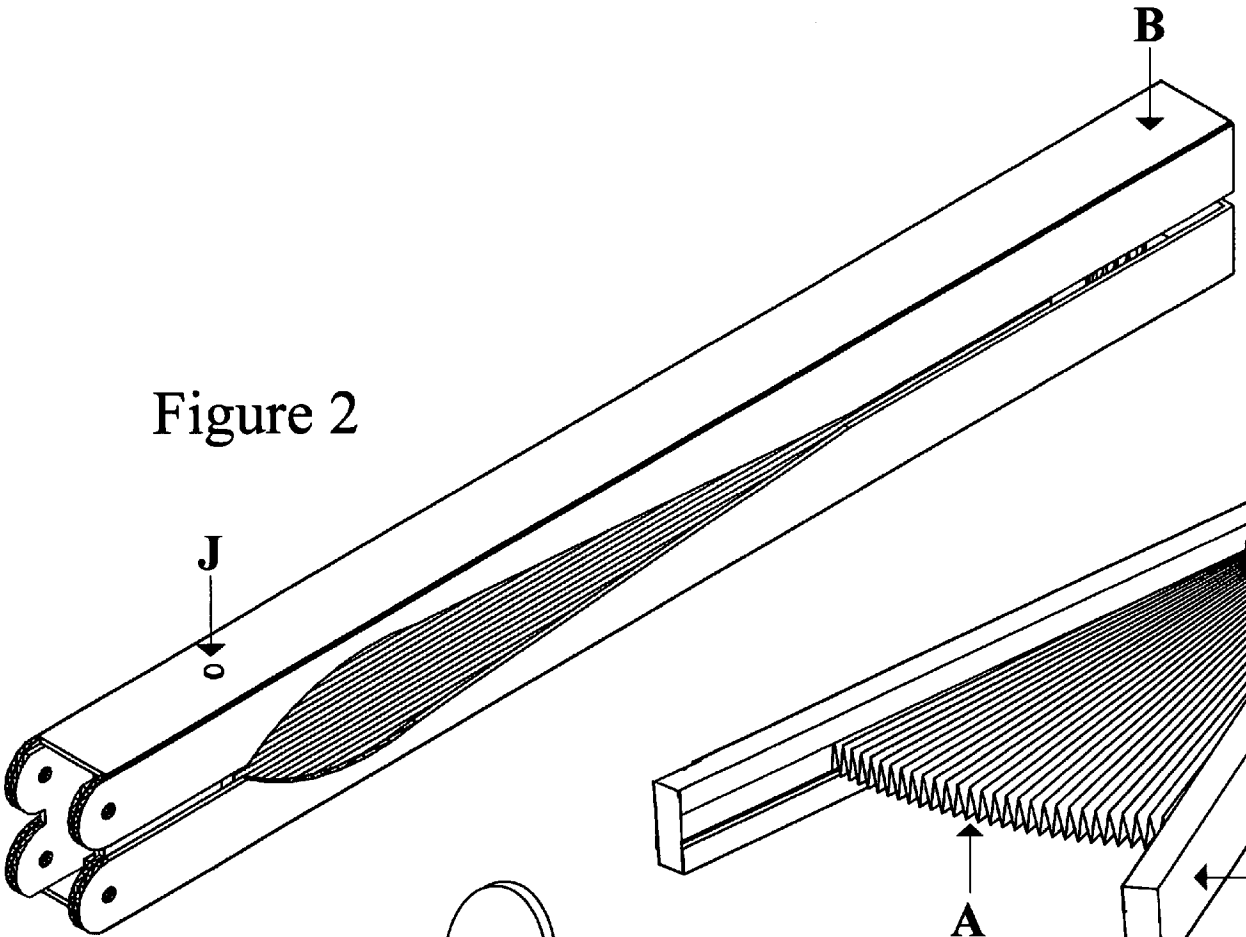
FIG. 2 Closed interchangeable hand-held fan unit illustrating external view of fan and docking port (J).
Figure 3:
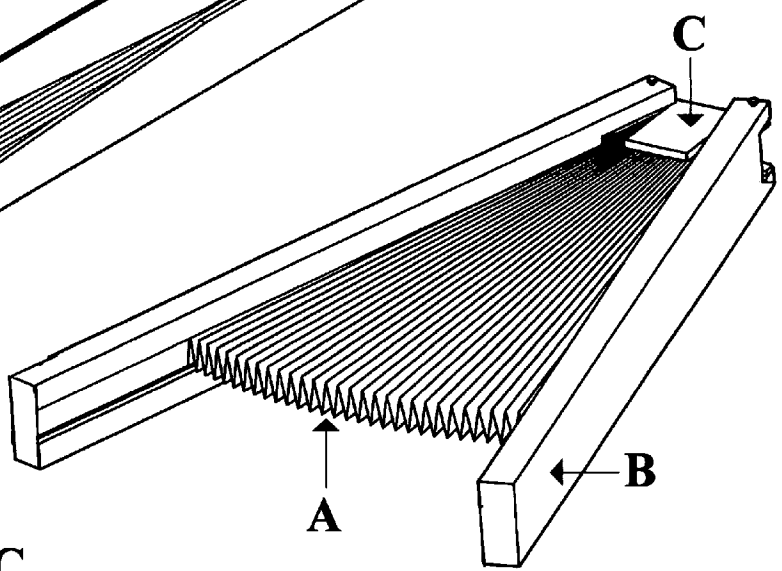
FIG. 3 Opening of interchangeable hand-held fan unit from a closed position.
Figure 2A:
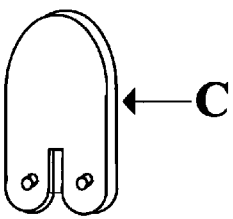

To open the purse fan with the interchangeable fan insert locked in place, each fan handle arm pivots to the full open position of 180 degrees and the magnetized handle tips allow the fan to stay open at 180 degrees (FIG. 2). The fan handles have small magnets placed in the hollow section of both ends of the fan handles which allows the handles to stay opened or closed.

To close an opened interchangeable hand held purse fan, the handle arms are pulled away from each other and pivoted 180 degrees to a closed position. The magnet in the handle's ends secures the closure.

The above description and examples should not be construed as limitations on the scope of the invention. Many other variations are possible. Accordingly, the scope of the invention is determined by the claims and their legal equivalents.

The Advantages of this Invention are:

- The fan inserts are interchangeable and can be coordinated with any color/style fan and utilize the same fan handle;
- The interchangeable fans fold down and are small enough to fit in a woman's small purse;
- The fans are sturdy, and air currents can be supplied to the face with manual propelling.

a. Fan Insert Unit (FIG. 4)

The fan insert is made of a fabric or paper reinforced with sizing, is cut in an oblong shape, is folded—accordion style (A), and is bonded with an adhesive at the base of the accordion fold, and secured with the adhesive attaching the fabric or paper to a paper tape binding at the base and side of the fan insert (I) and finally attached with adhesive to an encasement with a male glider exterior (G).

b. Fan Insert Unit Affixed to Male Glider Encasement (FIG. 4)

Figure 9:
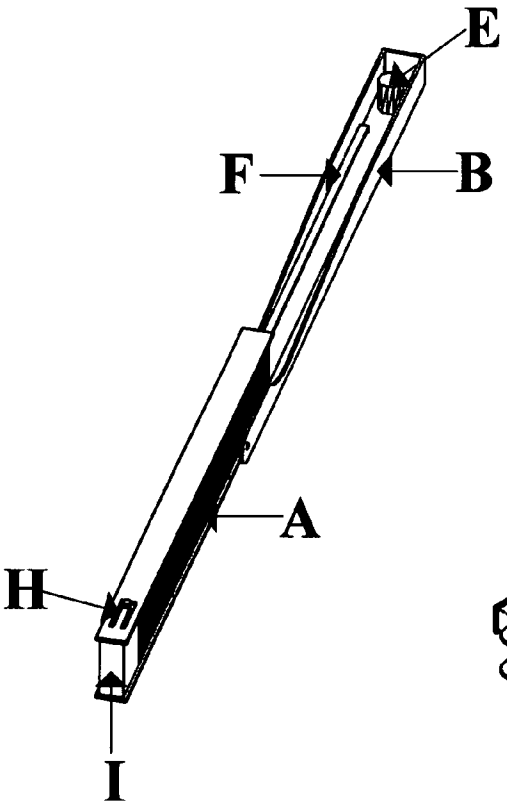
FIG. 9 Showing male glider tracks in bottom fan handle (F) for receiving the closed inter-changeable fan insert.
Figure 10:
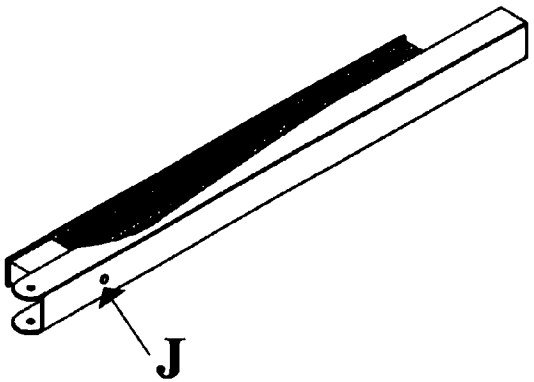
FIG. 10 Showing outside view of fan insert unit in place—the locking mechanism (H) on the closed fan insert locked onto the docking port handle on the handle (J).

The fan insert unit has a plastic male glider casing with grooved sides attached to the sides of the fan insert with an adhesive (G). A spring-board internal locking device is slightly elevated above one side of the casing (H) so that the fan inserts can be removed or inserted into various fan handles and stop when the inserts reaches the correct position and locks in place with the spring-board locking device on the plastic glider casing.

c. Fan Insert Unit Inserted into Fan Handle (FIGS. 5, 6 & 9)

The entire closed fan insert unit is inserted into the base of the fan handle unit. The spring-board internal locking device (H) is depressed by pushing it down with a finger. The male gliders attached on the outside arm of the fan insert unit (G) fit into the grooves of the female gliders in the fan handle unit and the fan insert travels down the grooved fan handle unit and locks into place (FIG. 9), when the spring-board internal locking device—an elevated stopper catcher—reaches the docking port and locks into place (FIG. 6).

d. How to Remove the Interchangeable Fan Insert (FIGS. 5 & 6)

Figure 8:
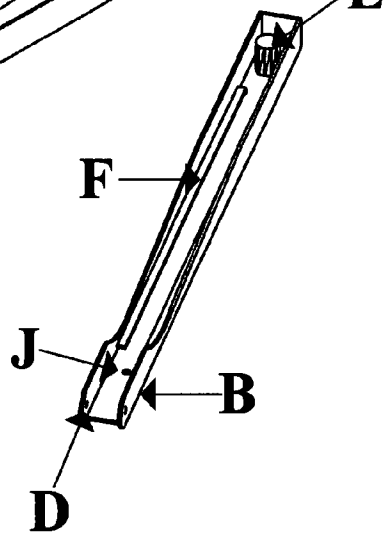
FIG. 8 View of internal fan handle (B) showing female gliders (F), magnet (E), and connector plate crew holes (D).

To remove the fan insert—the spring board locking mechanism on the fan insert is depressed (J) and the fan insert is released from the docking port of the fan handle. The fan insert is then pulled out and replaced.

e. Fan Handle Unit (FIGS. 2,8 & 9)

The fan handle unit is made from a group of materials of suitable wood, laminated wood, metal or plastic (B). The external surface of the fan handle unit may be coated with materials from the said group. The internal configuration of the fan handle unit (FIG. 8) is that each handle has a female glider made from a group of plastics or metals (F). Near the base of the fan insert unit is an elevated stopper catcher serving as a spring-board internal locking device for the inserted fan insert unit (FIG. 9-H). At the head of each fan handle unit is a small magnet (E) in the hollow end of the handle to serve as the closure unit when the fan is fully opened and the handles are parallel/adjacent in the open position or fully closed by having each fan handle moving 180 degrees to the closed position (FIG. 9).

What is claimed:

1. An interchangeable hand held fan apparatus comprising a fan handle unit and interchangeable fan insert units:

the fan handle unit comprising a set of fan handles made from at least one of a group of metal, laminated wood or plastic that is of equal length, cut to fit a typical adult female hand and cut to be ergonomically correct, said fan handles having rounded edges with smooth outside surfaces, each said inside handle having a hollow track with a grooved female glider;

said fan handles further having a small round magnet inserted in the hollow tip of both handles with said fan handles connected at the top with a fan lip affixed by screws to both handles, wherein the fan lip connector allows for movement and opening of the handles to a 180 degree angle;

an interchangeable fan insert unit for mating with a shell as formed by the fan handle unit and made of materials from a group consisting of accordion style folded fabric, leather, suede or paper treated with sizing, wherein said fan insert unit having a slightly raised male glider track mounted with adhesive on both sides of said insert; wherein said male glider tracks line up with female gliders on inside of said handles, said fan insert unit being placed in the said fan handles by lining up said fan insert unit male glider tracks with said handle female gliders and inserting said fan insert unit at the base opening of said handles and pushing said fan insert unit approximately ¾ of the way into said fan handle until a stopper locks said fan insert unit into place.

2. The apparatus of claim 1, wherein said fan lip also providing stability to said fan insert by being an approximately 1" tall round object made from materials from a group of metal, plastic or wood; and when said fan insert is in place and said fan handles are opened, said fan lip stabilizing said opened fan insert so that said fan insert providing stable and consistent cooling when the entire apparatus is moved back and forth to propel air currents.

3. The apparatus of claim 1, wherein said fan inserts being removable from said fan handles by depressing a lock on the outside of one handle thereby releasing the lock and allowing said insert to be spring-board ejected from said fan handles, wherein said fan insert being manually removed from said handles by pulling out said fan insert.

4. The apparatus of claim 3, wherein allowing that a different fan insert unit may be inserted into said fan handle by lining up the male glider on said fan insert with the female glider located on the hollow tracks of said fan handle; and whereas, once the fan insert is locked in place, said fan handle opens approximately 360 degrees, giving the appearance of a whole new fan to coordinate with the user's outfit, mood, or purpose for using a hand-held fan.

5. The apparatus of claim 1, wherein the fan insert unit is made from a group of sizing-treated paper or fabric cut to specifications for fitting in said fan handles, and folded accordion style and secured around the base of the fabric, paper or material of said fan insert with an adhesive and flexible bonding material encased around the bottom and sides which then allows said fan insert to stay affixed yet move to open up approximately 180 degrees.

6. A mechanism for interchanging fan inserts of a hand held fan apparatus comprising:

a fan handle unit comprising a set of fan handles having rounded edges with smooth outside surfaces, with the inside portion of each handle having a hollow track with a grooved female glider;

said fan handles further having a small magnet inserted in the hollow tip of both handles with said fan handles connected at the top with a fan lip affixed by screws to both handles, wherein the fan lip connector allows for movement and opening of the handles to a 180 degree angle;

an interchangeable fan insert unit for mating with a shell as formed by the fan handle unit, wherein said fan insert unit having a raised male glider track mounted with adhesive on both sides of said insert; wherein said male glider tracks line up with female gliders on inside of said handles, said fan insert unit being placed in the said fan handles by lining up said fan insert unit male glider tracks with said handle female gliders and inserting said fan insert unit at the base opening of said handles and pushing said fan insert unit approximately ¾ of the way into said fan handle until a stopper locks said fan insert unit into place;

said fan inserts being removable from said fan handles by depressing a lock on the outside of one handle thereby releasing the lock and allowing said insert to be spring-board ejected from said fan handles, wherein said fan insert being manually removed from said handles by pulling out said fan insert;

wherein allowing that a different fan insert unit may be inserted into said fan handle by lining up the male glider on said fan insert with the female glider located on the hollow tracks of said fan handle; and whereas once the fan insert is locked in place, said fan handle opens approximately 360 degrees, giving the appearance of a whole new fan to coordinate with the user's outfit, mood, or purpose for using a hand-held fan.

* * * * *